United States Patent [19]

Vahldieck

[11] Patent Number: 4,757,649

[45] Date of Patent: Jul. 19, 1988

[54] LEAF REJECTING RAIN GUTTER

[75] Inventor: Wayne Vahldieck, Massapequa Park, N.Y.

[73] Assignee: Yoder Manufacturing, Bedford Heights, Ohio

[21] Appl. No.: 42,502

[22] Filed: Apr. 27, 1987

[51] Int. Cl.[4] ..... E04D 13/06

[52] U.S. Cl. ..... 52/12; 52/11

[58] Field of Search ..... 52/12, 11; 210/474; 405/119

[56] References Cited

U.S. PATENT DOCUMENTS

| | | | |
|---|---|---|---|
| 603,611 | 5/1898 | Nye | 52/12 |
| 836,012 | 11/1906 | Cassen | 52/12 |
| 891,405 | 6/1908 | Cassens | 52/12 X |
| 2,669,950 | 2/1954 | Bartholomew | 52/12 |
| 2,672,832 | 3/1954 | Goetz | 52/12 |
| 2,873,700 | 2/1959 | Heier | 52/12 |
| 3,080,682 | 3/1963 | Teutsch | 52/12 |
| 4,404,775 | 9/1983 | Demartini | 52/12 |
| 4,411,110 | 10/1983 | Carey . | |
| 4,435,925 | 3/1984 | Jefferys | 52/12 |
| 4,493,588 | 1/1985 | Duffy | 52/12 X |
| 4,497,146 | 2/1985 | Demartini | 52/12 |

FOREIGN PATENT DOCUMENTS

| | | | |
|---|---|---|---|
| 318698 | 12/1969 | Sweden | 52/12 |

*Primary Examiner*—J. Karl Bell

*Attorney, Agent, or Firm*—Tarolli, Sundheim & Covell

[57] ABSTRACT

A gutter system for mounting under a structure's roof edge, which collects water run off in preference to leaves and debris, includes a shield, back support wall, and trough, integrally connected. The shield comprises a continuous double-curved convlute curve, generated on a first and a second radius, which extends from the back wall, down short of the inside of the front wall of the trough, and inward over the trough. The system is fastened to the structure by fastening means attached to the shield front, which pass generally horizontally under the shield and through the back support wall. In a preferred embodiment, the first radius has its origin generally where the trough bottom joins the back support wall, and the second radius has its origin generally at the fastening means, with their curves joining at a location where each is tangent to a common line.

20 Claims, 4 Drawing Sheets

LEAF REJECTING RAIN GUTTER

BACKGROUND OF THE INVENTION

1. Field of the Invention

In general this invention relates to a gutter system for collecting rain water. More particularly it relates to a rain gutter system for mounting under a roof edge for receiving water run off in preference to leaves and other debris.

2. Description of the Prior Art

The need to collect run off rain water from roofs while resisting entrance of leaves and other roof debris into the collection system is long recognized, as evidenced by the many patented inventions directed to this task.

One early invention U.S. Pat. No. 603,611, issued to B. F. Nye on May 3, 1898 teaches a sheet metal reverse "S" curve with its top located under the roof overhang flush with the underside of the overhang, and with the "S" curve's bottom turned up short of the top portion's curve, where the top portion's curve is nailed to a molding that extends out far enough to keep the top portions curve forward of the turned up bottom's edge.

The water leaves the roof and flows down over the curved wall by gravity and "capallary action", on into the gutter; while leaves, sticks and debris from the roof are carried to the edge of the top portion's curve, where they then drop from the forward jutting edge due to gravity, missing the gutter.

The Nye trough uses "gentle" curves throughout, because a sudden change in the surface would break the water's adherance to the sheet metal surface. The top of the "S" curve is mounted close under the roof edge, presenting a steep grade to the water flow as it leaves the roof edge. This can impart an angular velocity force to the water that overcomes its adhesion to the sheet metal, resulting in its ejection over and beyond the gutter edge or bottom curve's up turned forward edge.

Jefferys', U.S. Pat. No. 4,435,925, teaches a shield which extends beyond the forward edge of a trough, separately mounted below, as Nye's top curve extends beyond his gutter's forward edge, below.

Jeffery's shield, however, includes its own up turned gutter, short of, and below the upper curve's forward edge, which interlocks with a flange on the trough's front lip. This gutter which, in combination with the shield top, overseals the trough, includes parallel slits which are transverse to the gutter's length.

Water which travels down and under the front edge of the shield, enters the trough through the slits. Leaves and debris are said to fall off at the shield edge, and leaves and dust normally blown into a trough from other directions are stopped by the slitted strainer.

G. A. Bartholomew in U.S. Pat. No. 2,669,950 teaches a structure similar to Nye, and includes a plurality of laterally spaced projections which may be bumps or transverse ridges below the forward curve of the shield, directed downward to help strip the leaves from the surface before they reach the recessed gutter.

In Goetz, U.S. Pat. No. 2,672,832 the shield and trough are separately mounted. The back of the trough has a lip higher than the front lip, the back lip including a groove at its top for supporting the shield back by a mating channel. The back of the shield is located under the roof overhang, its forward extending curve being supported by nails and spaced from the structure wall by threaded sections located on spikes having forward shoulders to fix the distance of the threaded portions from the wall.

The trough is mounted to the wall by similar threaded spikes, which also help to support the shield by receiving its inwardly directed portion across their sides.

In U.S. Pat. No. 4,497,146, Demartini discloses a partial top section as in the top section of Nye's device, as a deflector cover for existing troughs, wherein the cover attaches to the top surface of a roof, and mounts over an existing trough, with its front edge being above and extending beyhond the trough's front edge. The partial top section includes the upper forward jutting curve and the inwardly directed surface below it, and adds a transverse strap, sheet metal screwed or otherwise fastened to its bottom surface. The strap extends to the existing of the inwardly directed portion, and attaches to the existing trough's front edge, or alternatively to the trough's support means.

Demartini's earlier patent, for a rain gutter device, U.S. Pat. No. 4,404,775 teaches separate shield and trough, with the shield attached on the top of the roof and having transverse ridges on the surface over the roof, to spread out and slow the water flow so that it will not attain angular acceleration forces which exceed the "surface tension" force holding the water to the forward extending curve so that it can follow the curve back far enough to fall behind the troughs recessed front edge.

In U.S. Pat. No. 4,411,110, R. J. Carey provides a trapezoidal form in which the shield front folds down inwardly, forming a top and the front face of a closed-in trough that is mounted under the overhang. The front face of the trough has longitudinal slots formed by inwardly and downwardly extending flaps punched into the sheet material. Water runs over the shield's forward jutting curve and back into the trough, while the slots screen out leaves and debris.

U.S. Pat. No. 4,493,588 awarded to G. R. Duffy closes the opening between the shield's forward protruding curve and trough's recessed front edge below, with wire mesh screening, instead of slots, to strain the leaves and debris from the water. As in Carey, the screen angles inward toward the trough front edge, thereby avoiding the upwardly facing collecting configuration of other screens. His shield is attached on the roof top and his trough is hung from suspension straps.

Although the earlier rain gutter devices will separate water from leaves and debris to greater or lesser extent, they are either in part or combination, complicated and costly to manufacture, difficult to inspect and clean. They require dual component, or dual fastener installation or modification to the structure to receive the device, or fastener holes in the top of the roof.

SUMMARY OF THE INVENTION

It is one object of the invention to provide a gutter system for receiving run off in preference to leaves and debris, which is simple to manufacture.

It is another object of the invention to provide a system which mounts as a single unit with a single row of fasteners.

It is another object to provide a system which mounts with minimum disturbance to the building structure's rain shielding surfaces.

It is another object to provide a system which collects water run off under light and heavy rain run off conditions.

Another object is to provide a system in which it is easy to inspect and clean the trough.

In accordance with the present invention there is provided a gutter system for receiving water run off in preference to leaves and debris. The system is mounted under the edge of a structure's roof, and includes a shield, back support wall, and a trough, integrally mounted to each other.

The trough includes a bottom which extends from the bottom of the back support wall, and a front wall having an inner face which faces the back support wall.

The shield comprises a continuous, double-curved convolute curve which extends from the back wall, travels down and turns inward over the trough. It may also be formed so that its lower end turns upward as well.

The system is fastened to the structure by nails or other fastening means attached to the shield front, which pass generally horizontally under the shield and through the back support wall. Spacing means are also included between the shield and back support wall to space it from the back wall.

The front of the shield falls short of the front wall of the trough so that the shield's curve does not extend beyond the tangency to a vertical drawn from the inner face of the front wall. It is preferred that the shield extends beyond 90 percent of the distance from the back support wall to the inner face so that leaves and other debris by-pass the trough. It is also within the contemplation of the invention to include an inwardly angled deflection lip on the top of the front wall.

The double curve is generated on a first radius for the upper curve and a second radius for the second curve of the double.

In a preferred embodiment, the first radius has its origin generally at the location where the trough joins the back support wall, and the second radius has its origin generally at the the fastening means, with their curves joining at a location where each is tangent to a common line.

In one embodiment the second radius has a length that is between one-quarter and one-eighth that of the first radius.

In another embodiment, raised ribs, transverse to the gutters length are located on the upper surface of the first curve, while the second curve is generally smooth from the common tangent of the two curves to its portion which faces the trough bottom.

In another embodiment the trough's front wall has a height that is approximately between one-eight and one-quarter the length of the first radius.

BRIEF DESCRIPTION OF THE DRAWINGS

The invention will now be described by way of example, with reference to the accompanying drawings, in which like elements carry like numerical designations.

DESCRIPTION OF THE PREFERRED EMBODIMENTS

Figure 1:
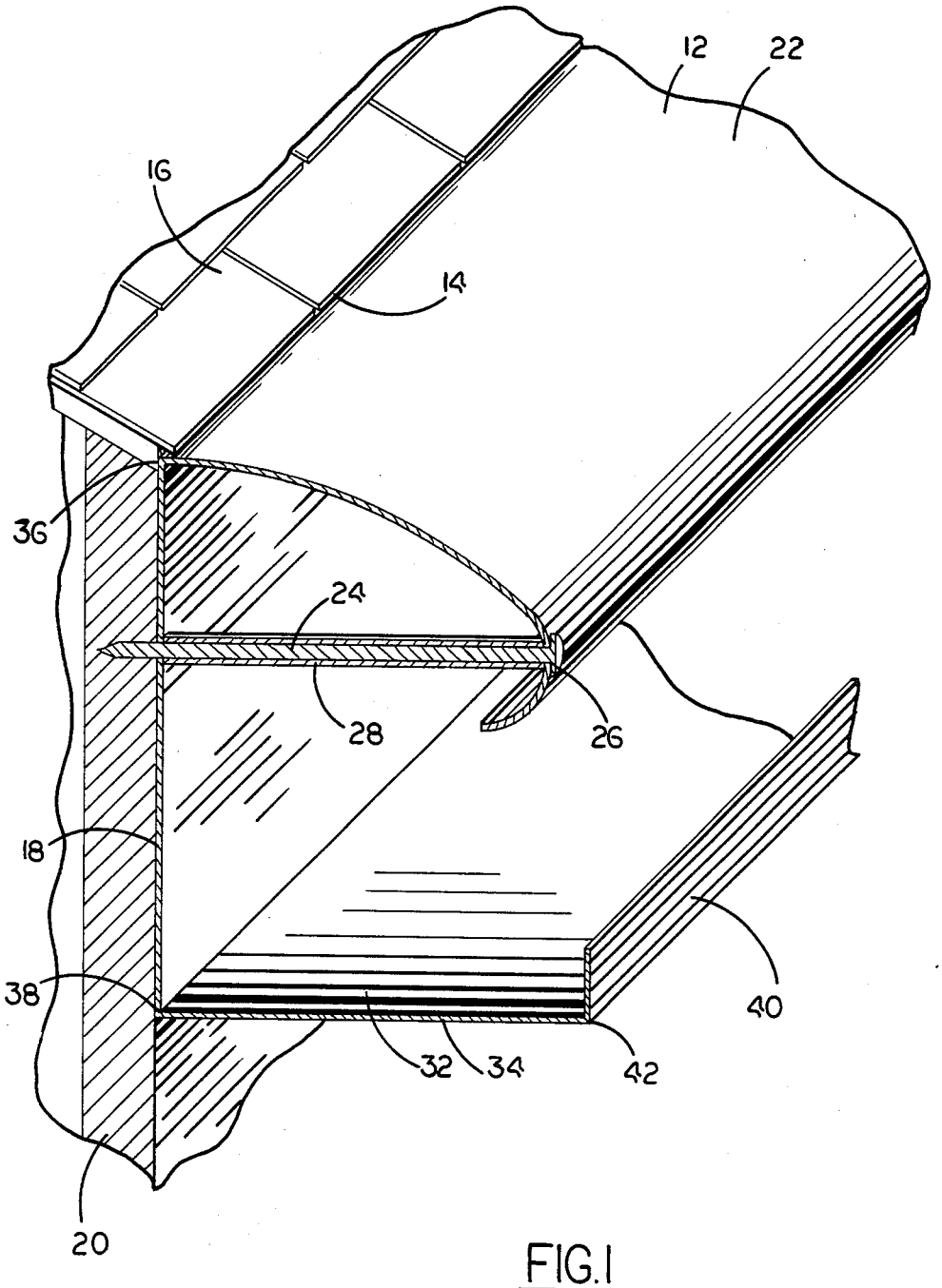
FIG. 1 is a side perspective view showing the leaf rejecting rain gutter attached to a structure, under its roof overhang.

With regard to the following detailed explanation, it is to be understood that the invention is not limited in its application to the detail of construction and arrangement of parts illustrated in the drawings, or the phraseology or terminology used in their explanation, since the invention is capable of being practiced in various ways.

FIG. 1 shows an elongated gutter system 12 for mounting under edge 14 of a roof 16 of a structure. Back support wall 18 abuts against wall 20 of the structure so that edge 14 hangs out beyond back support wall 18. Extending from, and integrally connected at its back with top 36 of back support wall 18 (under edge 14 in this figure), is upwardly convex, shield 22, extending outwardly and downwardly on a continuous double-curved convolute curve.

At the front of shield 22, aluminum fastening nail 24 passes through the shield. Extending generally horizontally under the shield and on through back support wall, the nail is lodged into the wall substance for holding the system in place. For a system having a 4" high back support wall, nails placed about every two feet apart along the length of the gutter will suffice to support the system when it is full of flowing water in windy conditions. When a nail is fully driven in for proper retention, nail head 26 is flush with the front of the shield. The back or concave surface abuts against spacer tube 28 which in turn abuts against the front 30 of back support wall 18 for spacing the shield from front 30.

Bottom 32 of trough 34 extends from and is integrally connected with bottom 38 of back support wall 18. Trough bottom 32 folds up at its front 42 to form front wall 40. Trough bottom 32 is shown in the figures with a flat surface. It is to be understood that it may be rounded to collect the water at its center or shaped to collect the water closer to the back end of the trough.

Figure 2:
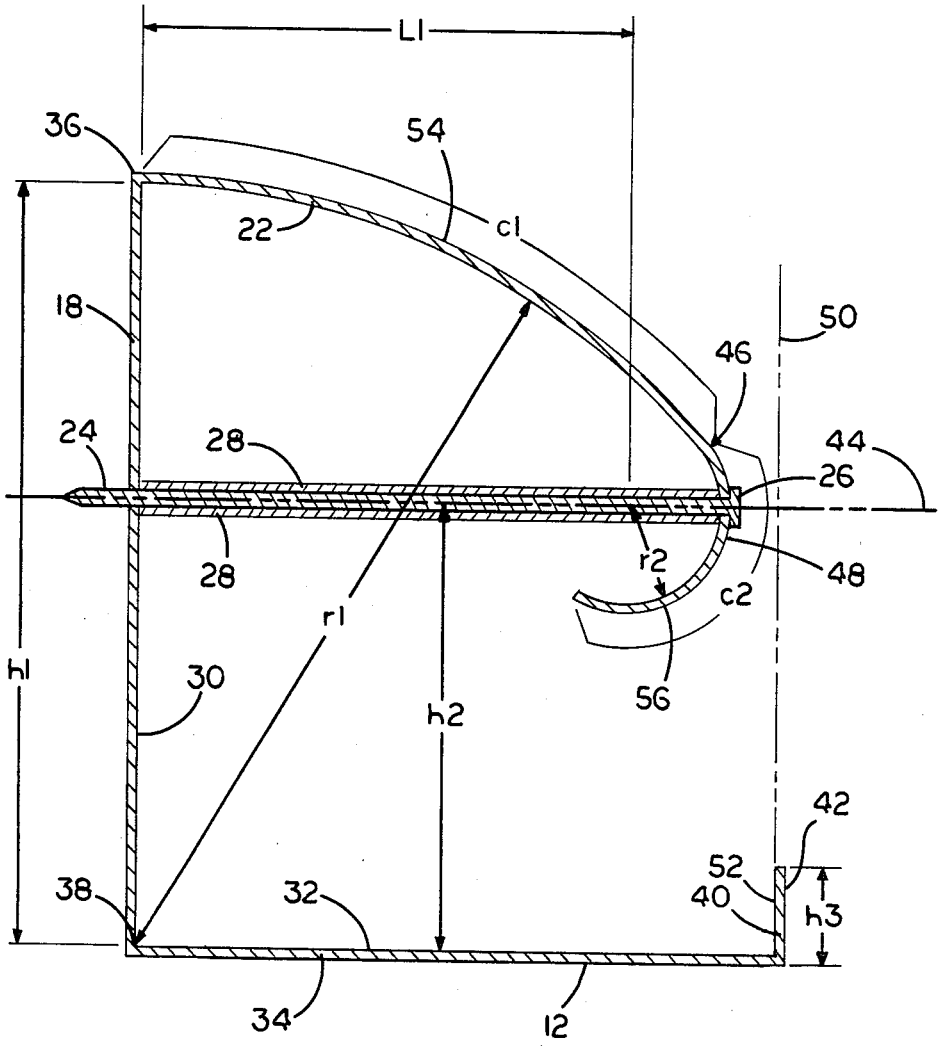
FIG. 2 is a side view showing relative dimensions according to one embodiment.

A preferred embodiment of the leaf guard gutter will now be discussed in more detail with reference to FIG. 2.

Shield 22 takes the form of a double-curved convolute in which a first curve, commencing at the top 36 of back support wall 18 is generated upon a first radius r1 having its origin where bottom 38 of back support wall 18 meets with bottom 32 of trough 34. Back support wall 18, joining with the shield at its top, of course has its height h1 equal to that of r1.

Fastening nail 24, which alternatively can be a screw or similar fastening means, is located with its horizontal center line 44 having a height h2 above the origin of r1 that is about 0.59 times the length of r1.

The second curve of the shield's double-curve has the origin of its radius r2 located on center line 44 of fastener nail 24, at a distance L1 from back support wall 18 approximately equal to 0.63 times the length of r1, such that the length of radius r2, and L1 cooperate to provide a smooth continuous curve of shield 22, with the first curve and the second curve joining at a location 46 where each is tangent to a common line.

Although the above ratios may vary slightly, without the curves mutually tangent to a line at their joining, without severely affecting the performance of the invention, it is preferred that the two curves be joined at a tangent in this manner in order to provide a smooth transition between them.

The second curve extends down around from tangent point 46, past a vertical drawn through its origin, and on back up before its end. In the embodiment described, the circumference lengths c1 and c2 of the first and second curves are about 0.88 and 0.45 that of r1.

Front 48 of shield 22 does not extend forward of the tangent to an imaginary vertical line 50 drawn from inner face 52 of trough front wall 40.

In this embodiment, front 48 falls within 0.13 to 0.06 of r1 from inner face 52, or line 50. Front wall 40 has a height h3 of 0.13 (r1).

In operation, the extended uniform curve of shield 22, the space between the front of the shield and line 50, and the height h3 of front wall 40, cooperate to separate leaves and debris from water, preferentially collecting the water.

First curve 54, generated on a relatively long radius, carries the water and debris downward and outward without undue acceleration. Imparting a very high acceleration to them would eject both water and debris out beyond inner face 52 of the trough. Instead, first curve 54 imparts sufficient angular velocity to eject the leaves and other debris forward of the top of trough front 42. Most of the water, however, not having sufficient angular velocity to overcome cohesion, travels further down onto second curve 56. Gaining angular velocity with speed and further, losing the support of gravity, it falls from curve 56 at various points starting from the curve's intersection with centerline 44. Its velocity need not be controlled as well as with prior art devices because the front wall of the trough is forward enough to catch streams of water that overcome cohesion due to attained higher angular velocity.

Figure 3:
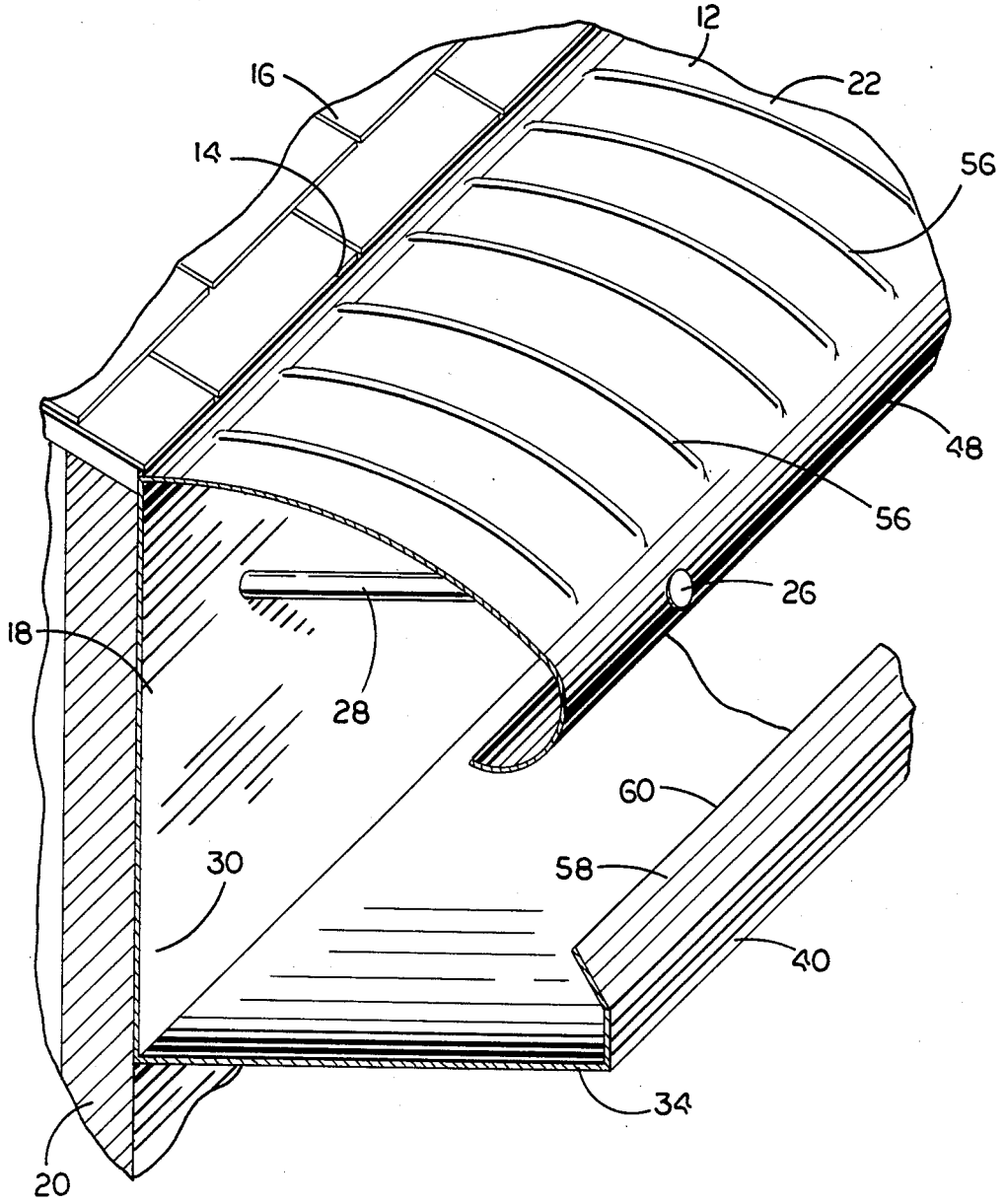
FIG. 3 is an end perspective view showing another embodiment of the invention.

FIG. 3 shows another embodiment of the invention in which raised ribs 56, on the first curve, traverse the gutter's length. The ribs elevate portions of leaves so that they and similar light weight debris may be caught by wind and blown from the surface of the shield. The second curve is not ribbed. The gradual change in slope of the first curve allows practical use of these transverse ribs because water velocity is not a problem. Higher velocities attendant with earlier discussed slopes would require that the water be spread over the surface of the shield or retarded with ribs that are parallel to the gutter's length.

Front wall 40 includes inwardly angled deflection lip 58, which has its top edge 60 forward of shield front 48. Deflection lip 58 helps to deflect leaves and debris and avoids presenting a vertical edge for the undesired material to catch on.

Figure 4:
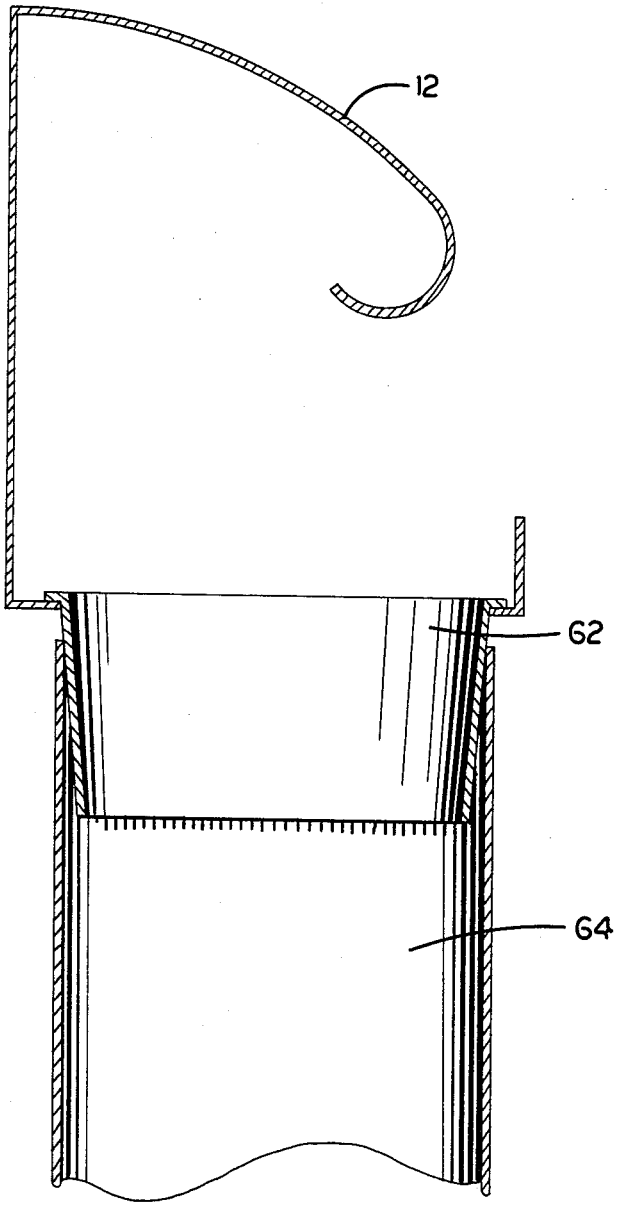
FIG. 4 is an end cross-section view of the invention with a leader connected.

FIG. 4 shows a typical throat 62 and leader 64 attached to the invention. The throat is located at one end of the elongated gutter system which is installed with a pitch toward it according to good construction practice.

Thus, it is seen that a gutter system is provided which receives water run off in preference to leaves and debris, that is of simple unitary construction, relatively inexpensive to manufacture, and simple to install under the edge of a roof by fastening along a single longitudinal plane without need to lift, displace or puncture the roof top. It may be formed in the field continuously because simple bends and curves are used, and if ribs 56 are desired, they are easily formed in the rather gradual, first curve.

It is not intended that the invention be limited to the particular embodiments discussed, as other embodiments would be obvious to those skilled in the art, without departing from the spirit and scope of the invention as set forth in the following claims.

I claim:

1. An elongated gutter system for mounting under the edge of a roof of a structure, for receiving water run off in preference to leaves and debris, said gutter comprising:

a back support wall having a top and a bottom, for mounting against a wall of the structure, a shield having a front and a back, permanently joined at its back with the top of said back support wall, a trough, integrally mounted to the bottom of said back support wall, said trough including a bottom extending from said back support wall, said bottom including a front wall having an inner face facing toward said back support wall, said trough's back support wall, bottom and front wall inner faces, defining an opening, said shield comprising a continuous, double-curved convolute the curve of which extends from the back wall, does not extend beyond the tangent to a vertical drawn from said inner face of the trough's front wall, and which turns inward over said trough before it ends, so that leaves and debris falling with an angular component received from the convolute surface generally pass beyond the lip, said shield not extending beyond said tangent to a vertical drawn from said inner face, for covering said trough opening, unitary means for fastening, passing through the shield at its front, passing generally horizontally under the shield, directly through said back support wall for passing into the structure's wall for fastening the gutter system to the structure wall, said means for fastening including means for spacing the shield front from the back support wall.

2. The invention as described in claim 1, further comprising:

said double-curve being generated upon a first radius for a first of the double, and a second radius for the second of the double, said first radius having its origin generally at said back support wall and below said means for fastening, and said second radius having its origin generally at said means for fastening, said curves joining at a location where each is tangency to a common line.

3. The invention as described in claim 2 further comprising:

said shield turning rearwardly upward over said trough opening before it ends.

4. The invention as described in claim 3 further comprising:

said shield front extending beyond 90 percent of the distance from said back support wall to said inner face.

5. The invention as described in claims 2, 3 or 4 further comprising:

said first radius having its origin generally at the location where said trough joins said back support wall.

6. The invention as described in claim 5 further comprising:

said second radius having a length between one-quarter and one-eighth the length of said first radius.

7. The invention as described in claim 5, further comprising:

said front wall having a height approximately between one-eighth and one-quarter the length of said first radius.

8. The invention as described in claim 7, further comprising:

an inwardly angled deflection lip on the top of said front wall, said lip having a top edge located forward of said shield.

9. The invention as described in claim 2, further comprising:

raised ribs, transverse to the gutter's length, located on the upper surface of said first curve, said second curve being generally smooth from their common tangent to its portion which faces the trough bottom said ribs minimum height being only that sufficient to reduce surface area contact between leaves and said first curve's upper surface.

10. An elongated gutter system for mounting under the edge of a roof of a structure, for receiving water run off in preference to leaves and debris, said gutter comprising:

a back support wall having a top and a bottom, for mounting against a wall of the structure, a shield having a front and a back, permanently joined at its back with the top of said back support wall, a trough, integrally mounted to the bottom of said back support wall, said trough including a bottom extending from said back support wall, said bottom including a front wall having an inner face facing toward said back support wall, said trough's back support wall, bottom and front wall inner face, defining an opening, said shield comprising a continuous, double-curved convolute the curve of which extends from the back wall, does not extend beyond the tangency to a vertical drawn from said inner face of the trough front wall, and which turns inward over said trough before it ends, so that leaves and debris falling with an angular component received from the convolute surface generally pass beyond the lip, said shield not extending beyond said tangent to a vertical drawn from said inner face, for covering said trough opening, unitary means for fastening, passing through the shield at its front, passing generally horizontally under the shield, directly through said back support wall far into the structure's wall for fastening the gutter system to the structure wall, said means for fastening being a spike and including fixed spacer means for spacing the shield front from the back support wall, said double-curve being generated upon a first radius for a first of the double, and a second radius for the second of the double, said first radius having its origin generally at the location where said trough joins said back support wall, and said second radius having its origin generally at said means for fastening and having a length between one-quarter and one-eight the length of said first radius, said curves joining at a location where each is tangent to a common line, said front wall having a height approximately between one-eighth and one-quarter the length of said first radius, said shield front extending beyond 90 percent of the distance from said back support wall to said inner face.

11. A method for receiving water run off from a roof in preference to leaves and debris, the method comprising:

catching the run off on the convex surface of a double-curve convolute shield having one of the double curves starting under the roof overhang, generated on a radius r1 having its origin under the overhang, allowing the run off to continue forward and down over the second curve having a radius r2 of one-quarter to one-half r1, said curves joining at a location where each is tangent to a common line, and further allowing the runoff to continue forward down over said second curve which passes rearwardly under its radius origin and back up rearward before it ends, whereby said runoff breaks away from the second curve and drops into a trough below, which extends from the origin of radius r1, to a forward distance beyond a vertical line that is tangent to the second curve, forward of the shield, where the trough has a lip less than one-quarter r1 in height such that leaves and debris falling with an angular component received from the convolute surface generally pass beyond the lip.

12. The invention as described in claim 1 or 2, further comprising:

said back support wall being relatively straight and not extending above said shield back where they join.

13. An elongated, integral gutter and shield combination for mounting under the edge of a roof of a structure for receiving water run off in preference to leaves and debris, and comprising:

a back support wall having a top and a bottom, for mounting against a wall of the structure, a shield having a front and a back, permanently joined at its back and integral with said back support wall, a trough having a front and back, permanently joined at its back and integral with the bottom of said back support wall, said trough including a bottom extending forwardly from said back support wall and a front wall extending upwardly from said bottom and having an inner face facing toward said back support wall, said trough's back support wall, bottom and front wall inner faces, defining an uninterrupted trough opening, said shield extending forwardly from said back wall and including a continuous, double-curved convolute, extending forwardly to and no further than a vertical tangent drawn from said inner face of said front wall of said trough, and which turns downward and inward over said trough before it ends for covering said trough opening so that leaves and debris falling with an angular component received from the convolute surface generally pass outwardly of said front wall, means for fastening said combination to the structure wall extending directly through said back support wall for passing into the structure's wall for fastening said gutter system to the structure wall, and means extending forwardly from said back wall to forward portions of said shield for supporting said shield forwardly of said support wall and above said trough, the front of said shield and the top of said trough front wall defining an uninterrupted vertical opening.

14. The combination as described in claim 12 in which said shield comprises a continuous, double-curved convolute, the curve of which extends from said back wall.

15. The combination as described in claim 12 in which said means for supporting said shield forwardly of said support wall comprises means for spacing the shield front from the back support wall and from the top of said trough-front wall.

16. The combination as described in claim 13 wherein said trough bottom is flat.

17. The combination as described in claim 13 wherein said back support wall is flat substantially throughout its height.

18. The combination as described in claim 13 including an inwardly deviated deflation lip on the top of said front wall, said lip having a top edge located forwardly of said shield.

19. The combination as described in claim 13 including said ribs located on the upper surface of said shield.

20. The combination as described in claim 19 wherein said ribs extend transverse to said gutter's length.

* * * * *